US008061587B2

(12) United States Patent
Blin

(10) Patent No.: US 8,061,587 B2
(45) Date of Patent: Nov. 22, 2011

(54) CARTON FOR MULTIPLE ARTICLES

(75) Inventor: Patrick Blin, Chateauroux (FR)

(73) Assignee: Meadwestvaco Packaging Systems, LLC, Richmond, VA (US)

( * ) Notice: Subject to any disclaimer, the term of this patent is extended or adjusted under 35 U.S.C. 154(b) by 830 days.

(21) Appl. No.: 10/598,096

(22) PCT Filed: Feb. 17, 2005

(86) PCT No.: PCT/US2005/005147

§ 371 (c)(1), (2), (4) Date: May 1, 2008

(87) PCT Pub. No.: WO2005/080218

PCT Pub. Date: Sep. 1, 2005

(65) Prior Publication Data

US 2010/0147933 A1 Jun. 17, 2010

(30) Foreign Application Priority Data

Feb. 17, 2004 (GB) ..... 0403470.8

(51) Int. Cl.
*B65D 17/28* (2006.01)

(52) U.S. Cl. ..... 229/242; 206/427; 229/122

(58) Field of Classification Search ..... 229/240, 229/241, 242, 122; 206/427; 221/302, 305
See application file for complete search history.

(56) References Cited

U.S. PATENT DOCUMENTS

| | | | | |
|---|---|---|---|---|
| 902,347 | A | | 10/1908 | Tillinghast |
| 1,541,143 | A | | 6/1925 | Hoile |
| 1,925,102 | A | | 9/1933 | Levkoff |
| 2,542,180 | A | * | 2/1951 | Chemlinski ..... 206/45.2 |
| 2,718,301 | A | | 9/1955 | Palmer |
| 2,723,027 | A | | 11/1955 | Guyer |
| 2,842,304 | A | * | 7/1958 | Ringler |
| 2,930,516 | A | | 3/1960 | Fowle et al. |
| 2,975,891 | A | | 3/1961 | Stone |
| 3,002,651 | A | | 10/1961 | Gauld |
| 3,018,031 | A | | 1/1962 | Ahlbor et al. |
| 3,178,242 | A | * | 4/1965 | Ellis et al. |
| 3,228,582 | A | * | 1/1966 | Osberg |
| 3,263,861 | A | | 8/1966 | Carr |
| 3,265,283 | A | | 8/1966 | Farquhar |
| RE26,083 | E | | 9/1966 | Forrer |
| 3,300,115 | A | | 1/1967 | Schauer |

(Continued)

FOREIGN PATENT DOCUMENTS

DE 75 10 538 8/1975

(Continued)

*Primary Examiner* — Gary Elkins
(74) *Attorney, Agent, or Firm* — MWV Intellectual Property Group

(57) ABSTRACT

A carton for a group of bottles arranged in rows is of substantially tubular structure comprising a bottom panel (18), a first side panel (16), a top panel (14), a second side wall panel (12) and end closure panels for at least partially closing the ends of the carton. The carton has an access means, integrally formed in the carton walls and is defined by a weakened line of severance (3). The access means provides a means for accessing the bottles contained within the carton while providing means for retaining the articles to prevent them from being inadvertently dislodged. The access means being formed so that the carton can be oriented to sit on either its bottom panel or the second side panel while articles are accessed via an opening in the first side wall panel.

14 Claims, 4 Drawing Sheets

U.S. PATENT DOCUMENTS

| | | | | | |
|---|---|---|---|---|---|
| 3,332,594 | A | | 7/1967 | Capua | |
| 3,356,279 | A | | 12/1967 | Root | |
| 3,517,858 | A | | 6/1970 | Farquhar | |
| 3,540,581 | A | | 11/1970 | Koolnis | |
| 3,599,858 | A | | 8/1971 | Samsing | |
| 3,669,251 | A | | 6/1972 | Phillips, Jr. | |
| 3,747,801 | A | * | 7/1973 | Graser | 206/200 |
| 3,765,527 | A | | 10/1973 | Vargo | |
| 3,829,006 | A | | 8/1974 | Spiegel | |
| 3,894,681 | A | | 7/1975 | Arneson et al. | |
| 3,913,739 | A | | 10/1975 | Hennessey | |
| 4,000,811 | A | | 1/1977 | Hardison et al. | |
| 4,030,596 | A | | 6/1977 | Snyder et al. | |
| 4,058,206 | A | * | 11/1977 | Morse et al. | 229/241 |
| 4,214,660 | A | | 7/1980 | Hunt, Jr. | |
| 4,222,485 | A | | 9/1980 | Focke | |
| 4,256,226 | A | * | 3/1981 | Stone | 206/427 |
| 4,274,580 | A | * | 6/1981 | Arnold | |
| 4,318,474 | A | | 3/1982 | Hasegawa | |
| 4,325,482 | A | | 4/1982 | Feeser | |
| 4,364,509 | A | | 12/1982 | Holley et al. | |
| 4,375,258 | A | | 3/1983 | Crayne et al. | |
| D270,041 | S | | 8/1983 | Vestal | |
| 4,396,143 | A | | 8/1983 | Killy | |
| 4,398,636 | A | | 8/1983 | Baxter | |
| 4,416,410 | A | | 11/1983 | Hermann | |
| 4,417,661 | A | | 11/1983 | Roccaforte | |
| 4,566,593 | A | | 1/1986 | Muller | |
| 4,582,199 | A | | 4/1986 | Schuster | |
| 4,588,084 | A | | 5/1986 | Holley, Jr. | |
| 4,726,471 | A | | 2/1988 | Whately et al. | |
| D303,090 | S | | 8/1989 | Armor et al. | |
| 4,919,266 | A | | 4/1990 | McIntosh et al. | |
| 4,974,771 | A | | 12/1990 | Lavery | |
| 5,031,825 | A | | 7/1991 | Romagnoli | |
| 5,067,615 | A | | 11/1991 | Davitian | |
| 5,123,589 | A | | 6/1992 | Cote | |
| 5,137,211 | A | | 8/1992 | Sumner et al. | |
| 5,170,934 | A | | 12/1992 | Lemoine | |
| 5,279,440 | A | | 1/1994 | Fougeres et al. | |
| 5,368,194 | A | | 11/1994 | Oliff et al. | |
| 5,465,831 | A | | 11/1995 | Smith | |
| 5,582,345 | A | * | 12/1996 | Lankhuijzen | 229/235 |
| 5,622,309 | A | | 4/1997 | Matsuda et al. | |
| 5,699,957 | A | | 12/1997 | Blin et al. | |
| 5,722,584 | A | | 3/1998 | Fujiwara | |
| 5,775,574 | A | | 7/1998 | Whitnell | |
| 5,833,118 | A | | 11/1998 | Weiss | |
| 5,857,570 | A | * | 1/1999 | Brown | 206/427 |
| 5,878,947 | A | | 3/1999 | Hoy et al. | |
| 5,881,884 | A | | 3/1999 | Podosek | |
| 6,105,854 | A | | 8/2000 | Spivey et al. | |
| D436,859 | S | | 1/2001 | Botsford et al. | |
| 6,168,027 | B1 | | 1/2001 | Esser | |
| 6,176,419 | B1 | | 1/2001 | Holley et al. | |
| 6,283,293 | B1 | * | 9/2001 | Lingamfelter | |
| D454,784 | S | | 3/2002 | Oram | |
| 6,386,369 | B2 | * | 5/2002 | Yuhas et al. | |
| 6,435,351 | B1 | | 8/2002 | Gibb | |
| 6,484,903 | B2 | | 11/2002 | Spivey et al. | |
| 6,550,615 | B2 | * | 4/2003 | Lingamfelter | |
| 6,578,736 | B2 | * | 6/2003 | Spivey | |
| 6,789,673 | B2 | * | 9/2004 | Lingamfelter | |
| 2001/0000203 | A1 | | 4/2001 | Yuhas et al. | |
| 2002/0088820 | A1 | | 7/2002 | Spivey | |
| 2002/0170845 | A1 | * | 11/2002 | Oliff | 206/749 |
| 2003/0141313 | A1 | | 7/2003 | Bates | |
| 2003/0234285 | A1 | | 12/2003 | Bates et al. | |
| 2006/0255114 | A1 | | 11/2006 | Hand et al. | |
| 2007/0164093 | A1 | | 7/2007 | Spivey | |

FOREIGN PATENT DOCUMENTS

| | | | | |
|---|---|---|---|---|
| DE | 8514718 | U1 | | 6/1985 |
| DE | 85 14 718.4 | U1 | | 8/1985 |
| DE | 36 12 594 | A1 | | 10/1987 |
| EP | 0 323 596 | A1 | | 7/1989 |
| EP | 0475147 | B1 | | 3/1992 |
| EP | 0475147 | A1 | * | 6/1994 |
| EP | 0 849 189 | A1 | | 6/1998 |
| EP | 0694011 | B1 | * | 12/1999 |
| EP | 1360116 | | * | 2/2006 |
| GB | 1420024 | | * | 1/1976 |
| GB | 1420024 | A | | 1/1976 |
| GB | 2252546 | A | | 8/1992 |
| WO | WO 96/29260 | A1 | | 9/1996 |
| WO | WO 97/21607 | A1 | | 6/1997 |

* cited by examiner

CARTON FOR MULTIPLE ARTICLES

TECHNICAL FIELD OF THE INVENTION

The invention relates to cartons and more particularly to a carton for multiple articles having a dispenser for constrained removal of individual articles.

BACKGROUND OF THE INVENTION

Cartons for encasing multiple articles are useful for enabling consumers to obtain and transport a desired quantity of individual articles such as soft drinks or other beverages. When such a multiple-pack of articles is obtained, a consumer often requires removal of the articles individually. Thus it can be appreciated that a carton with a dispensing feature that facilitates the removal of a single article from the carton at a time would be desirable.

Cartons designed for dispensing beverage cans one at a time are known in the art. Often the cans are packaged in two rows and disposed upon their sides in rolling contact with the bottom of the carton. This may not be a suitable orientation if the articles contained were more fragile, such as glass bottles, and the cartons needed to be stacked on top of each other.

State of the art cartons have dispensers which allow only one or two of the cans contained within the carton to be accessed by the user at a time. However it may sometimes be desirable to have a choice of which article to dispense, if, for example, the carton were to contain a variety of different flavoured products.

Dispensing features on cartons for containing cans, often employ the can's ability to roll, to assist their removal. This kind of dispensing feature would not work with articles that were not cylindrical, for example, rectangular juice cartons. Thus it can be appreciated that a carton for encasing, carrying and dispensing asymmetric articles, such as bottles would be desirable.

It would be problematic for articles to be dispensed undesirably from the carton, especially if such articles were made from an easily breakable material such as glass. Thus it can be appreciated that it would be desirable to have a carton with a dispenser suitable for safely carrying and dispensing bottles.

SUMMARY OF THE INVENTION

According to a first aspect of the present invention, there is provided a carton for a plurality of similar articles, such as bottles, arranged in rows wherein the carton is of a substantially tubular structure comprising a bottom panel, a first side wall panel, a top panel, a second side wall panel and a means for at least partially closing the ends of the carton to prevent the articles from being undesirably dislodged, the carton further comprising an access means, integrally formed in the carton walls and being defined by a weakened line of severance, the weakened line of severance extending across a carton side wall along an axis of the tubular structure the access means providing means for retaining the articles to prevent them from being inadvertently dislodged and further being structured and arranged such that the carton can be oriented to sit on either the bottom panel or one of its side panels whilst the articles are accessed through an opening formed when the dispensing feature is utilized in the other of its side wall panels.

Preferably, the articles are bottles and are disposed such that the bottom of the bottles abuts the bottom panel.

Alternatively, the weakened line of severance extends through the top panel, first side panel and ends of the carton.

According to an optional feature of this aspect of the present invention, there is provided a hand-hole punch through means for providing easy access to the dispensing feature.

According to an optional feature of this aspect of the present invention, the bottom panel is larger than the top panel.

According to an optional feature of this aspect of the present invention, the means for closing the ends of the cartons comprises four end flaps hinged to the top panel, first side panel, bottom panel and second side panel.

Preferably, end flaps hinged to the first and second side walls contain weakened lines of severance.

According to a second aspect of the present invention, there is provided a blank for forming a carton for a plurality of similar articles, such as bottles, arranged in rows wherein the carton is of a substantially tubular structure comprising a bottom panel, a first side wall panel, a top panel, a second side wall panel and a means for at least partially closing the ends of the carton to prevent the articles from being undesirably dislodged, the carton further comprising an access means, integrally formed in the carton walls and defined by a weakened line of severance, said access means providing means for retaining the articles to prevent them from being inadvertently dislodged and further being structured and arranged such that the carton can be oriented to sit on either the bottom panel or one of its side panels whilst the articles are accessed through an opening formed when the dispensing feature is utilized in the other of its side wall panels.

Preferably, at least two adjacent panels contain transverse lines of weakness which are contiguous when the blank is formed into the carton.

Preferably, the means for at least partially closing the ends of the carton includes at least one additional line of weakness which cooperates with the transverse lines of weakness to form the dispensing feature when the blank is formed into the carton.

According to a third aspect of the present invention, there is provided a tubular carton having opposed end closure walls, wherein an article dispenser is provided by a removable portion defined by an endless tearline which includes a first segment extending across a top wall along the tubular axis, a second segment extending across a first side wall along the tubular axis and a pair of third segments formed respectively in the end closure walls to interconnect the first and second segments to form the endless tearline.

Preferably, each end closure wall includes a pair of upper and lower end flaps and a pair of side end flaps, wherein each third segment comprises an upper portion in the respective upper end flap and a lower portion in the side end flap that is hinged to the first side wall.

Preferably, each third segment further comprises an intermediate portion in the respective lower end flap and wherein the intermediate portion interconnects the upper and lower portions.

Alternatively, a part of the first segment defines a tear initiation tab, and wherein each third segment extends downwardly from the top wall away from the first side wall so that an upper portion of each third segment adjoining the top wall is disposed at an obtuse angle with respect to the first segment.

Alternatively, in which at least two adjacent panels contain transverse lines of weakness which are contiguous when the blank is formed into the carton.

Alternatively, the means for at least partially closing the ends of the carton includes at least one additional line of weakness which cooperates with the transverse lines of weakness to form the dispensing feature when the blank is formed into the carton.

BRIEF DESCRIPTION OF THE DRAWINGS

FIGS. 1 to 5 illustrate one embodiment of the present invention. The invention will now be described by way of example with reference to the accompanying drawings, in which;

FIG. 1 is a plan view of a carton blank according to one embodiment of the invention.

FIG. 2 is a perspective top, front and side view of a carton erected from the blank of FIG. 1.

FIG. 3 is a view of the carton as in FIG. 2 also showing the closing of an end of the carton, by end panels.

FIG. 5 is a perspective rotated view of the carton of FIG. 4*b* with the displaced part of the front wall removed showing the carton for use in a dispensing position.

Corresponding features are indicated by the same reference numerals in the figures.

DETAILED DESCRIPTION OF THE PREFERRED EMBODIMENTS

Figure 1:
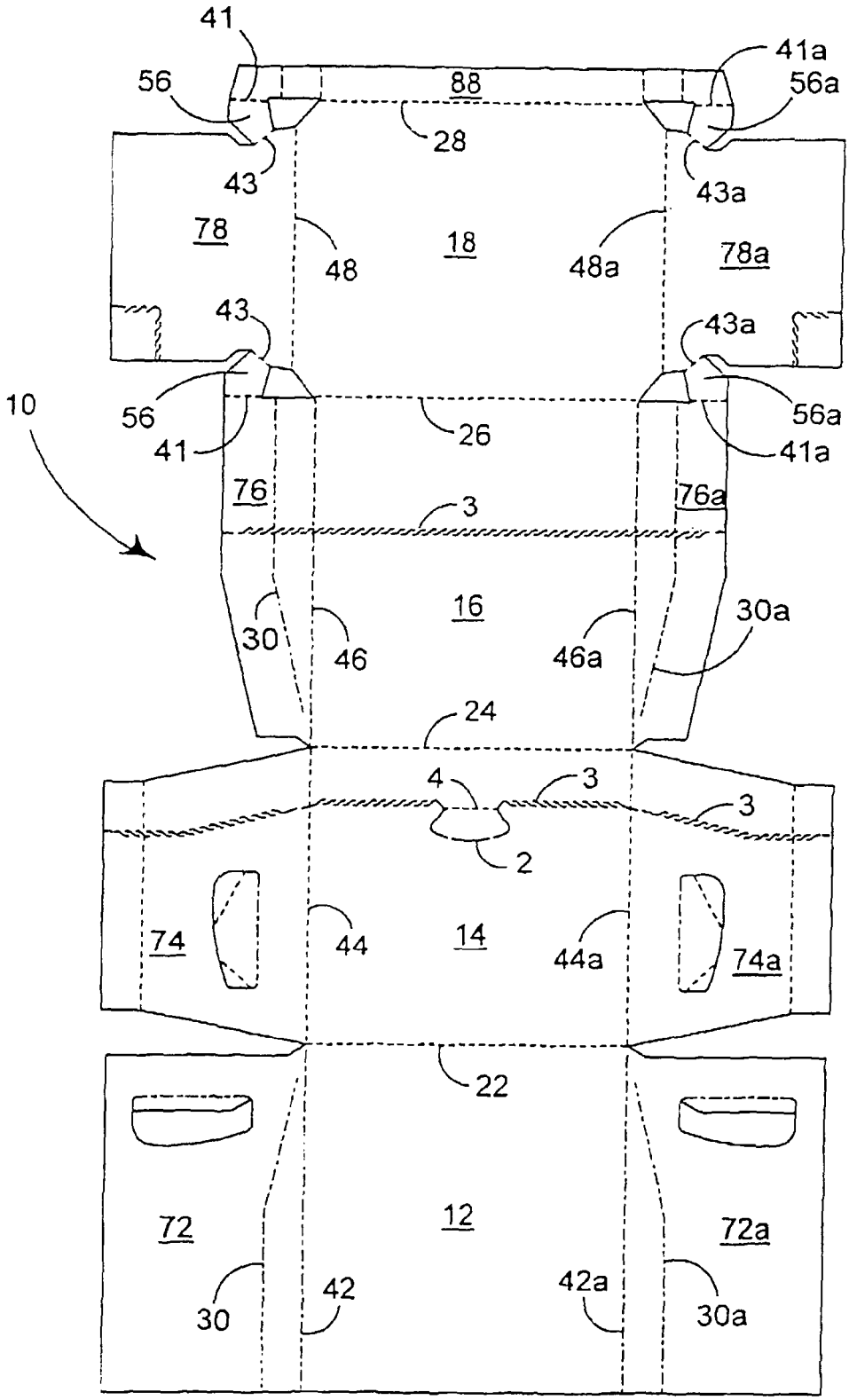

FIG. 1 shows a blank 10 from which the carton of FIGS. 2, 3, 4 and 5 is erected. The blank 10 is vertically elongate as viewed in FIG. 1 and is formed of paperboard. However the blank 10 may be formed of other foldable material such as a plastic sheet or the like. The blank 10 of the preferred embodiment is designed for packaging asymmetric bottles of an identical configuration, arranged in two rows of six. However it is foreseen that in other embodiments of the present invention the articles contained may not be bottles and they may be arranged in more than two rows and indeed the rows may contain more or less than six articles Referring to FIG. 1 the blank 10 includes four primary panels for forming the carton walls, a first side wall panel 16, a top wall panel 14, a second side wall panel 12 and a bottom wall panel 18. The primary panels are foldably connected one to the next along fold lines 22, 24 and 26. A glue flap 88 is foldably connected to the bottom wall panel 18 along a fold line 28. Reference numerals 72/72*a*, 74/74*a*, 76/76*a* and 78/78*a* designate end flaps which are hinged by fold lines 42/42*a*, 44/44*a*, 46/46*a* and 48/48*a* to both ends of the primary panels 12, 14, 16 and 18 respectively. At each corner of the bottom wall panel 18 is a webbing panel or corner gusset 56/56*a*. Webbing panels 56/56*a* are foldably connected to end flaps 78/78*a* along fold lines 43/43*a*. The webbing panels 56/56*a* connect end flaps 78/78*a* to neighbouring end flaps 76/76*a* and glue panel 88. The webbing panels 56/56*a* are hinged to the neighbouring end flaps 76/76*a* and glue panel 88 via fold lines 41/41*a*.

When the carton formed from the blank of FIG. 1 is loaded, the articles are fed in from one or both of the open ends of the carton in two lines side by side so that the larger ends of the bottles abut the bottom wall panel 18 and the smaller bottle top ends of the bottles abut the top wall panel 14. The end flaps are then folded and glued to form front and rear ends which close the carton.

Figure 2:
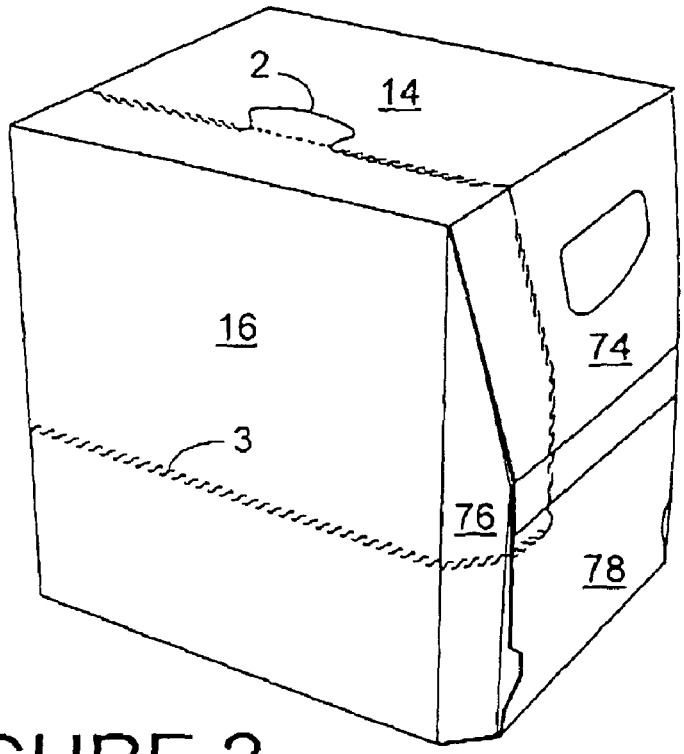
Figure 3:
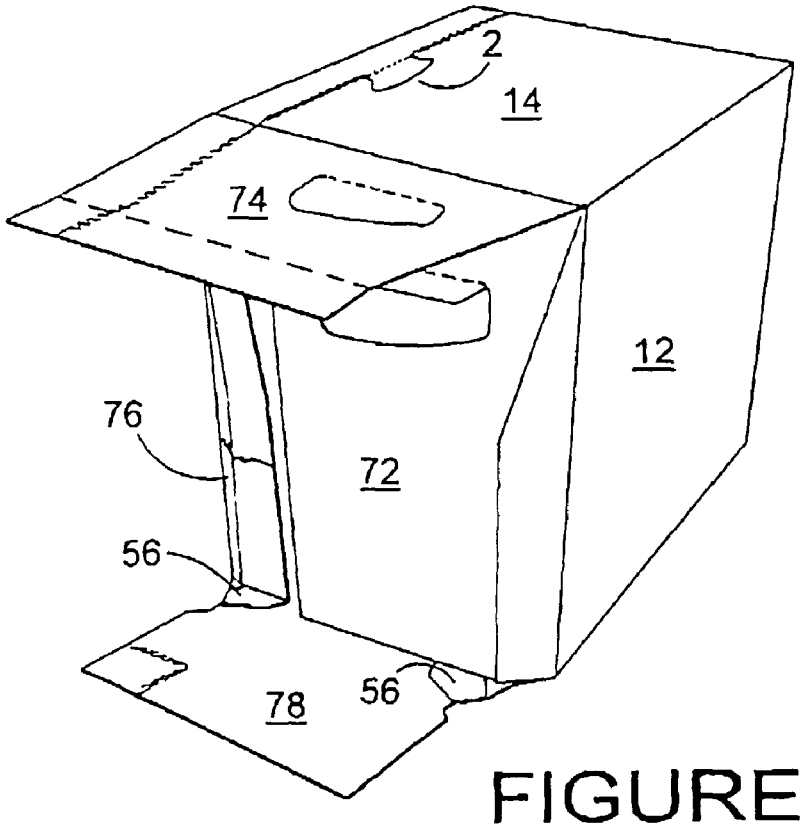

An erected carton formed from the blank 10 is shown in FIG. 2. To form an erected carton as in FIG. 2, the second side wall panel 12 is folded along the fold line 22 to lie flat on the top wall panel 14. Glue is applied to the glue flap 88 and then the bottom wall panel 18 is folded along the fold line 26 to lie flat on the first side wall panel 16. By this means, the second side wall panel 12 is glued to the glue flap 88 and thereby a flat tubular carton is provided. The flat tubular carton is then expanded into an open-ended tubular form. The webbing panels 56/56*a* hinged to the glue panel 88 effectively become hinged end flaps 72/72*a*. At both ends of the tubular carton the bottom wall panel 18 is foldably connected via fold lines 41/41*a* and 43/43*a* and webbing panels 56/56*a* to the end flaps 72/72*a* and 76/76*a*. After bottles are loaded through one or both of the open ends of the carton, the end flaps 72/72*a*, 74/74*a*, 76/76*a* and 78/78*a*, are folded to close both ends of the carton. End flaps 72 and 76 are folded inwardly, along fold lines 42 and 46 respectively, assisted by the webbing panels 56 which fold along lines 41 and 43 to lie in flat face contact with end flap 78, as shown in FIG. 3. Glue may be applied to the outermost faces of end flaps 72 and 76, before end flap 74 is folded down along fold line 46, to become partially stuck to end flaps 72 and 78. More glue may then be applied to end flap 74, so that when end flap 78 is folded up along fold line 48 it is glued to the front face of end flap 74 and the respective end of the carton is closed. The erected and closed carton formed from blank 10 of FIG. 1 is shown in FIG. 2.

In the preferred embodiment of the invention weakened lines 30/30*a* extend through end flaps 72/72*a* and 76/76*a*. The weakened lines 30/30*a* provide a structural function and enable the erected carton to have slightly rounded corners rather than abrupt edges. The slightly rounded or bevelled corners may provide additional protection of the bottles contained within the carton. The weakened lines 30/30*a* of the preferred embodiment are shaped complementarily to the shape of end flaps 74/74*a*.

The bottom panel 18 is, in the preferred embodiment of the invention, slightly larger than the top wall panel 14 so that the carton has a tapered shape which may further serve to protect the bottles contained within the carton.

The erected carton in FIGS. 2 and 3 shows a dispensing feature integrally formed at a front end portion of the carton. The dispensing feature or access means is employed to allow access to the bottles contained in the carton, whilst the bottles are also prevented from being undesirably dislodged from the carton.

In the preferred embodiment of the invention the dispensing feature is integrally formed in the top wall panel 14, the first side wall panel 16, and end flaps 74, 74*a*, 76, 76*a*, 78 and 78*a*. Weakened lines of severance 3 define the dispensing feature which extends from a hand-hole punch through in the top wall panel 14. The hand-hole punch through is defined by a second weakened line of severance 2 and a fold line 4. The insertion of a finger into the hand-hole punch through will cause the hand-hole punch through to fold into the carton about fold line 4 which will cause the second weakened line of severance 2 to sever, creating a hole or aperture in the carton which provides an easy access opening for the dispensing feature. The dispensing feature is defined by the weakened lines of severance 3 which extend from either side of the fold line 4, bisecting the top wall 14. The dispensing feature comprises part of the end walls of the carton. The weakened line of severance 3 continues from the top wall through end flaps 74/74*a*, 78/78*a* and 76/76*a* and terminates in the first side wall panel 16.

Figure 4A:
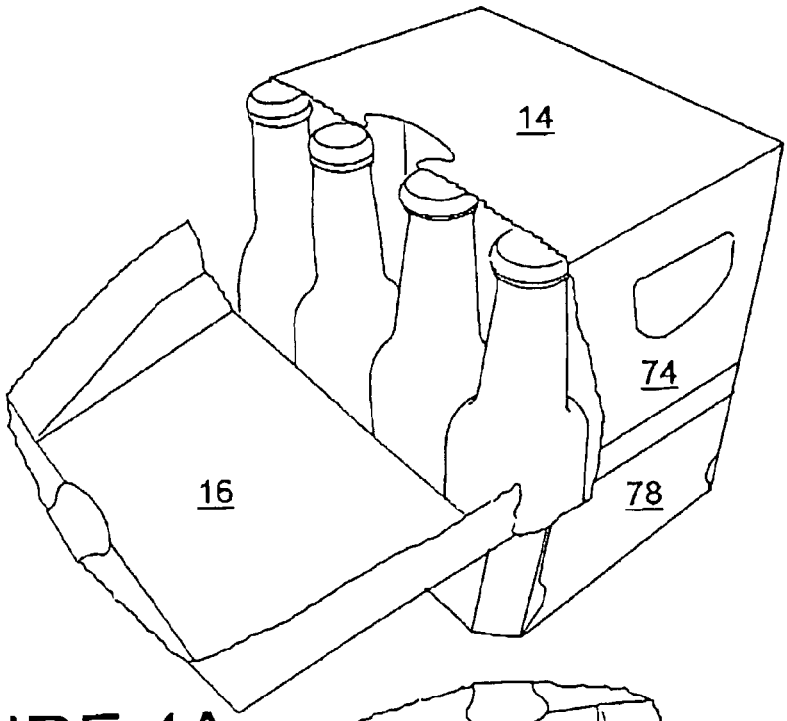
FIG. 4*a* is a view of the carton as in FIG. 2 with part of the front wall displaced.
Figure 4B:
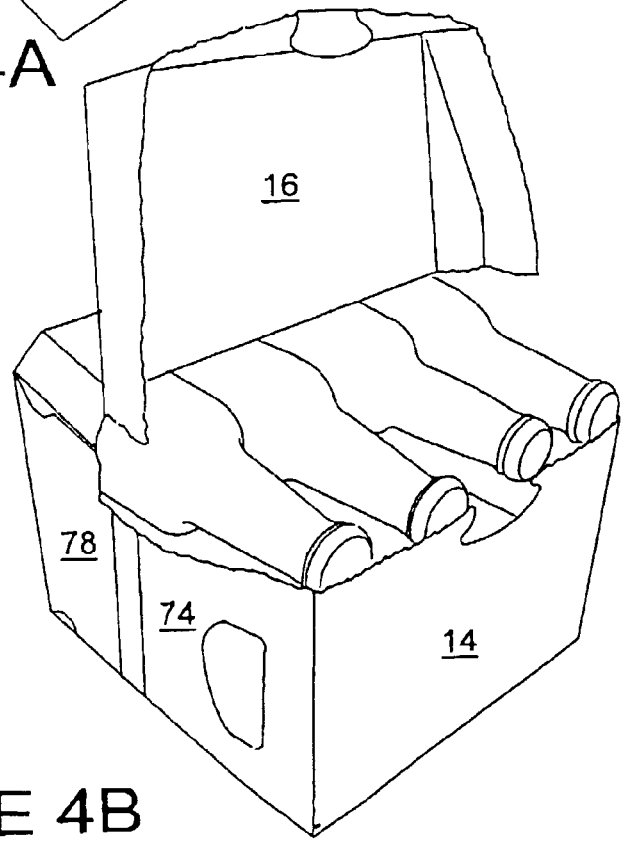
FIG. 4*b* is a view of the carton as in FIG. 4*a*, with the carton oriented to sit on a side wall panel.
Figure 5:
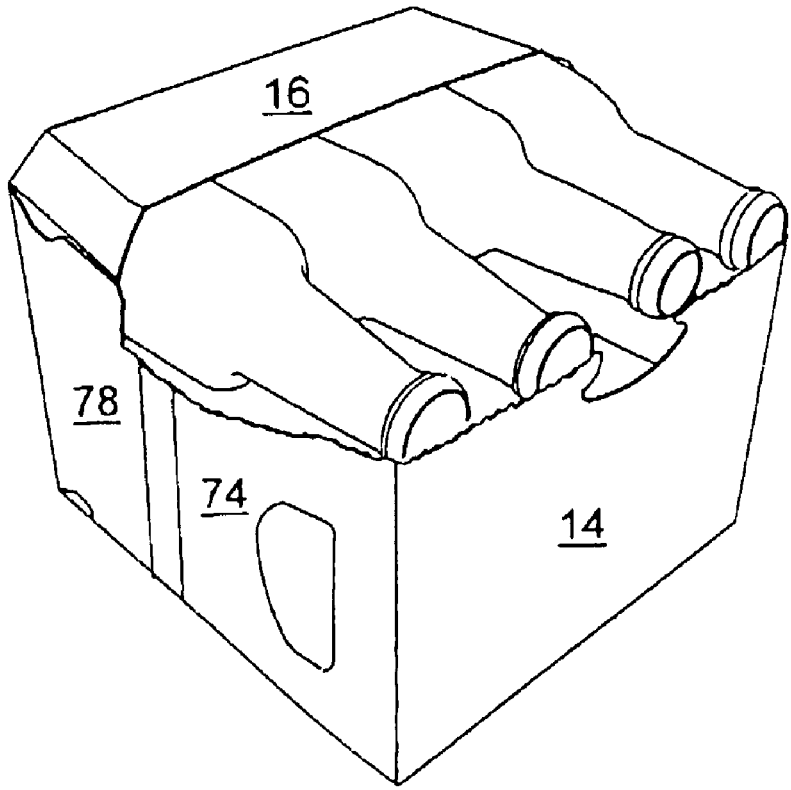

In use as a dispensing carton the carton may be rotated so that it stands on its bottom wall panel 18 or on the second side wall panel 12, so that the first side wall 16 is then viewed as the top wall and the top and bottom wall panels 14 and 18 are viewed as the sides of the carton. In either position the bottles may be retained within the carton and are prevented from being undesirably dislodged, but whilst access to multiple bottles at the same time is enabled by displacing the dispensing feature. FIG. 4*a* shows the carton in a first orientation and FIG. 4*b* shows a second orientation whereby the bottles are seen as two rows one on top of the other. In other embodiments of the invention the bottles may be stacked in more than two rows. Partial removal of the dispensing feature allows the bottles neighbouring the first side wall 16 to be accessed as shown in FIG. 4*a* and FIG. 4*b*. Complete removal of the dispensing feature is shown in FIG. 5. In the two orientations of FIGS. 4*a* and 4*b*, it is either an undisplaced portion of top wall panel 14 or the first side wall 16 that prevents bottles from being undesirably dislodged from the carton, whilst allowing at the same time easy access to the bottles.

In the preferred embodiment of the invention the end flaps 74/74*a* and 72/72*a* contain weakened lines that define apertures. When the end flaps are folded to close the ends of the carton the apertures align and form handles for the easy carrying of the carton. In other embodiments of the invention a handle may be situated in the top wall panel 14.

The orientation of the carton as shown in FIG. 4*b* may be suitable for use in a fridge, where the carton could sit on a shelf for example and the bottles could be removed individually by easily grasping the necks of the bottles. The user could also choose which bottle to dispense which may be advantageous if the carton were to contain a variety of flavours.

It is envisaged that the endless weakened line of severance 3 that defines the dispensing feature could follow a different shaped path and thus create a different shaped dispensing feature whilst still providing access to the articles contained within.

It will be recognised that as used herein, directional references such as "top", "base", "end", "side", "inner", "outer", "upper" and "lower" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It should be understood that various changes may be made within the scope of the present invention, for example, the size and shape of the panels and apertures may be adjusted to accommodate articles of differing size or shape, alternative top and base closure structures may be used. The carton may accommodate more than one article in different arrays.

The invention claimed is:

1. A carton comprising a plurality of similar, substantially cylindrical articles, a plurality of panels connected together to form a substantially tubular structure in which the articles are received, the plurality of panels comprising a bottom panel, a first side wall panel, a top panel and a second side wall panel, the carton further comprising opposed end closure walls for at least partially closing opposed ends of the tubular structure respectively, the carton further comprising a dispensing feature integrally formed with at least one of the plurality of panels, the dispensing feature being defined by an endless tear line which comprises a first segment extending completely across the top panel between the opposed ends of the tubular structure, a second segment extending completely across one of the first and second side wall panels between the opposed ends of the tubular structure and a third segment extending in each of the opposed end closure walls between the first and second segments, the dispensing feature providing an opening for allowing the articles to be accessed therethrough when removed from the carton, the dispensing feature providing a retainer adjacent the opening for retaining the articles to prevent the articles from being inadvertently dislodged when the dispensing feature removed from the carton, wherein the articles are arranged such that the articles sit on the bottom panel and such that an axis of each of the articles is disposed substantially perpendicular to the bottom panel.

2. The carton of claim 1 wherein the second segment extends across the one of the first and second side walls panels along a tubular axis of the tubular structure.

3. The carton of claim 1 further comprising a hand-hole punch through for providing easy access to the dispensing feature.

4. The carton of claim 1 wherein the bottom panel is larger than the top panel.

5. The carton of claim 1 wherein each of the end closure walls comprises four end flaps hingedly connected to the top panel, first side wall panel, bottom panel and second side wall panel respectively.

6. The carton of claim 5 wherein at least two of the end flaps of the each of the end closure walls include a respective one of the third segments.

7. The carton of claim 1 wherein the dispensing feature comprises a removable portion defined by the first, second and third segments, the first segment extending along a tubular axis of the tubular structure, the second segment extending along the tubular axis, and the third segments interconnect the first and second segments to form the endless tear line.

8. The carton of claim 7 wherein each of said end closure walls includes a pair of upper and lower end flaps hingedly connected to the top and bottom panels respectively and a pair of side end flaps hingedly connected to the first and second side wall panels respectively, wherein each of said third segments comprises an upper portion in a respective one of said upper end flaps and a lower portion in a respective one of the side end flaps that are hinged to said one of the first and second side wall panels.

9. A carton for a plurality of similar articles, comprising a plurality of panels connected together to form a substantially tubular structure, the plurality of panels comprising a bottom panel, a first side wall panel, a top panel and a second side wall panel, the carton further comprising opposed end closure walls for at least partially closing opposed ends of the tubular structure respectively, the carton further comprising a dispensing feature integrally formed with the carton, the dispensing feature being defined by an endless tear line which comprises a first segment extending completely across the top panel between the opposed ends of the tubular structure, a second segment extending completely across one of the first and second side wall panels between the opposed ends of the tubular structure and a third segment extending in each of the opposed end closure walls between the first and second segments, the dispensing feature providing an article access opening when removed from the carton, the dispensing feature providing an article retainer when removed from the carton, wherein the dispensing feature comprises a removable portion defined by the first, second and third segments, the first segment extending along a tubular axis of the tubular structure, the second segment extending along the tubular axis, and the third segments interconnect the first and second segments to form the endless tear line, wherein each of said end closure walls includes a pair of upper and lower end flaps hingedly connected to the top and bottom panels respectively and a pair of side end flaps hingedly connected to the first and second side wall panels respectively, wherein each of said third segments comprises an upper portion in a respective one of said upper end flaps and a lower portion in a respective one of the side end flaps that are hinged to said one of the first and second side wall panels, wherein each of said third segments further comprises an intermediate portion in a respective one of said lower end flaps and wherein each of the intermediate portions interconnects said upper and lower portions of a respective one of the end closure walls.

10. A carton for a plurality of similar articles, comprising a plurality of panels connected together to form a substantially tubular structure, the plurality of panels comprising a bottom panel, a first side wall panel, a top panel and a second side wall panel, the carton further comprising opposed end closure walls for at least partially closing opposed ends of the tubular structure respectively the carton further comprising a dispensing feature integrally formed with the carton, the dispensing feature being defined by an endless tear line which comprises a first segment extending completely across the top panel between the opposed ends of the tubular structure, a second segment extending completely across one of the first and second side wall panels between the opposed ends of the tubular structure and a third segment extending in each of the opposed end closure walls between the first and second segments, the dispensing feature providing an article access opening when removed from the carton, the dispensing feature providing an article retainer when removed from the carton wherein the dispensing feature comprises a removable portion defined by the first, second and third segments, the first segment extending along a tubular axis of the tubular structure, the second segment extending along the tubular axis, and the third segments interconnect the first and second segments to form the endless tear line, wherein each of said end closure walls includes a pair of upper and lower end flaps hingedly connected to the top and bottom panels respectively and a pair of side end flaps hingedly connected to the first and second side wall panels respectively, wherein each of said third segments comprises an upper portion in a respective one of said upper end flaps and a lower portion in a respective one of the side end flaps that are hinged to said one of the first and second side wall panels, wherein a part of said first segment defines a tear initiation tab, and wherein each of said third segments extends downwardly from the top panel away from said one of the first and second side wall panels so that an upper portion of each of said third segments adjoining the top panel is disposed at an obtuse angle with respect to a hinged connection between the top panel and a respective one of the upper end flaps.

11. A blank for forming a carton, comprising a plurality of panels hingedly connected together in series, the plurality of panels forming a tubular structure when the blank is erected into a carton, the plurality of panels including a top panel, a bottom panel and a pair of first and second side wall panels, the blank further comprising a pair of upper end flaps hingedly connected to opposed ends of the top panel respectively, a pair of lower end flaps hingedly connected to opposed ends of the bottom panel respectively, and a pair of side end flaps hingedly connected to opposed ends of each of the first and second side wall panels respectively, the blank further comprising a plurality of tear line segments comprising a first segment extending completely across the top panel between the opposed ends of the top panel, a second segment extending completely across the first side wall panel between the opposed ends of the first side wall panel, and a pair of third segments, the third segments comprising a pair of upper portions extending across the upper end flaps respectively, a pair of lower portions extending across the side end flaps of the first side wall panel respectively, and a pair of intermediate portions extending across the lower end flaps respectively, the intermediate portions are positioned and configured such that each of the intermediate portions interconnects a respective one of the upper portions and a respective one of the lower portions when the blank is erected into a carton.

12. The blank of claim 11 in which the first, second and third segments are connected together to form a single endless tear line when the blank is formed into a carton.

13. The blank of claim 11 wherein the each of the intermediate portions is substantially V-shaped.

14. The blank of claim 11 wherein each of the lower end flaps has a free end edge opposing a hinged connection between the bottom panel and the each lower end flap and a pair of side edges extending from the free end edge toward the hinged connection, and wherein the each of the intermediate portions extends from the free end edge of a respective one of the lower end flaps to one of the side edges of the respective lower end flap.

* * * * *